US005983578A

United States Patent [19]

Huttie et al.

[11] Patent Number: 5,983,578

[45] Date of Patent: Nov. 16, 1999

[54] PENETRATION-RESISTANT SECURITY PASSWAY AND DOOR THEREFOR

[75] Inventors: A. David Huttie, Glendale; Maurice A. Black, Litchfield Park, both of Ariz.

[73] Assignee: Arizona Public Service Company, Phoenix, Ariz.

[21] Appl. No.: 08/974,619

[22] Filed: Nov. 19, 1997

[51] Int. Cl.[6] ..... E04H 1/12; E05G 5/00

[52] U.S. Cl. ..... 52/79.1; 52/79.6; 52/143; 52/783.12; 109/1 S; 109/42; 109/49.5; 109/83; 49/501

[58] Field of Search ..... 109/1 S, 6, 8, 109/67–68, 42, 78, 83, 49.5; 52/79.1, 79.3, 125.2, 169.6, 79.6, 143, 455, 309.7, 783.12, 656.4; 49/501

[56] References Cited

U.S. PATENT DOCUMENTS

| | | | |
|---|---|---|---|
| 1,768,092 | 6/1930 | Alstadt | 109/6 X |
| 3,600,870 | 8/1971 | Greenhalgh | 52/125 X |
| 3,709,168 | 1/1973 | Ludwig | 109/1 S |
| 3,773,475 | 11/1973 | Madden, Jr. | 29/192 |
| 3,947,546 | 3/1976 | Louise et al. | 423/242 |
| 4,063,519 | 12/1977 | Pretini | 109/8 |
| 4,122,783 | 10/1978 | Pretini | 109/8 X |
| 4,194,431 | 3/1980 | Markus et al. | 89/36 A |
| 4,202,279 | 5/1980 | Rand | 109/34 |
| 4,461,222 | 7/1984 | Brunner et al. | 109/29 |
| 4,481,887 | 11/1984 | Urbano | 109/3 |
| 4,662,289 | 5/1987 | Harder | 109/49.5 |
| 4,841,692 | 6/1989 | Coupard et al. | 52/173 |
| 4,961,448 | 10/1990 | Timm | 141/9 |
| 5,014,629 | 5/1991 | Timm | 109/34 |
| 5,050,507 | 9/1991 | Shoyat | 109/83 |
| 5,187,316 | 2/1993 | Hasler et al. | 89/36.02 |
| 5,206,451 | 4/1993 | Bocker | 109/1 S X |
| 5,216,965 | 6/1993 | Liptak et al. | 109/49.5 X |
| 5,325,084 | 6/1994 | Timm et al. | 340/541 |
| 5,660,021 | 8/1997 | Wolgamot et al. | 109/76 X |

FOREIGN PATENT DOCUMENTS

| | | | |
|---|---|---|---|
| 2334809 | 12/1977 | France | 109/8 |

*Primary Examiner*—Carl D. Friedman
*Assistant Examiner*—Winnie S. Yip
*Attorney, Agent, or Firm*—Meschkow & Gresham, P.L.C.; Jordan M. Meschkow; Lowell W. Gresham

[57] ABSTRACT

A penetration-resistant modular security passway (20) includes a concrete vestibule (24), a doorframe (70), and a penetration-reactive security door (32). The vestibule (24) has a plurality of reinforcing members (36), a plurality of lifting lugs (26), and an embedded passive antipersonnel device (56). The doorframe (70) has hinge and strike jambs (108,110) attached to the reinforcing members (36). The hinge jamb (108) has a plurality of studs (124) and the strike jamb (110) a plurality of deadbolts (126) for protrusion into the door (32). The door (32) has a substruction (72), to which are affixed grates (86,92) and cladding (84,90). A girdle (100) is affixed to the cladding (84,90). Within a space (76) within the substruction (72), a metallic cable (78) is woven and a plurality of individually sealed tubes (96) containing a foaming agent (98) under pressure are suspended.

35 Claims, 13 Drawing Sheets

PENETRATION-RESISTANT SECURITY PASSWAY AND DOOR THEREFOR

TECHNICAL FIELD OF THE INVENTION

The present invention relates to the field of security passways. More specifically, the present invention relates to the field of penetration-resistant security passways for structure entrances.

BACKGROUND OF THE INVENTION

There exists a global need for the protection of sensitive structures from assault by an armed aggressor. Especially vulnerable to attack are nuclear power station containment and turbine buildings, armaments and munitions stores, weapons and biological research facilities, etc.

Weak points in the security of such structures are often entrances, especially entrances other than the primary entrances of the structures. Such non-primary entrances are traditionally protected by the use of a security door coupled with video cameras and other electronic devices. The outside area adjacent to the entrance is usually well illuminated and patrolled either physically or by video. To a trained aggressor, such protective measures are not an effective deterrent.

In the current world environment, security leaks are rampant. Data describing security systems and patrol schedules are often compromised. Additionally, an aggressor is likely to be well-trained, well-equipped, and acting for a "cause," i.e., willing to die to achieve a specific goal. There exists, therefore, a considerable problem in the protection of non-primary entrances to sensitive structures from assault by a skilled and determined aggressor in possession of suitable intelligence and materiel to achieve the aggressor's goal.

For example, were the destruction of a target at a specific facility to be the desired goal, an aggressor would have to assault the building housing the target. To accomplish this, an aggressor may utilize commando techniques to bypass perimeter security and gain access to the area adjacent to the building. Once in the appropriate area, the aggressor need only wait in concealment until patrolling guards have passed and are an appropriate distance away. The aggressor may then, in rapid succession, plant explosives to breach the security door, seek cover while the door is breached, gain ingress through the breached door, and use explosives to destroy the target. The first indication of assault may be the breaching of the door, with all subsequent actions occurring with sufficient rapidity to render the patrolling guards incapable of preventing the destruction of the target. The guards may, of course, be in a position to incapacitate the aggressor after the aggressor's goal has been achieved. Whether or not the aggressor can escape is often irrelevant.

As is exposed by the above assault scenario, a severe problem exists with conventional unguarded-door security methodology, especially since such "security" doors are often little more than glorified metal fire doors and are usually not proof against an explosive assault. The conventional solution is therefore to place a guard at the entrance in question. However, this in itself poses several problems.

A guard is subject to ennui, be the guard an individual or a team. It is virtually impossible to keep a guard alert indefinitely. After months or years without incident, an "if it hasn't happened, it won't happen" mentality can set into the subconscious and decrease the efficiency of the guard. In fact, the guard may suffer ennui to the point where there is effectively no guard at all, especially when there is a total absence of activity and boredom is at a maximum, as in the small hours of the morning. A traditional partial solution to this problem is an increase in random, unscheduled, and frequent simulated assaults and other training drills. Unfortunately, the use of such drills can in some ways actually decrease the efficiency of a guard, e.g., in the event of an actual assault, the guard may hesitate before initiating appropriate actions (i.e., actions requiring deadly force) on the assumption that "it's only another drill." Such a hesitancy may be all that is required to allow an aggressor to overcome the guard and gain ingress.

Additionally, in a well-planned and concerted assault, an aggressor may be able to overcome a guard without triggering an alarm. Such an attack is especially likely when the aggressor is in possession of suitable intelligence. Naturally, a guard consisting of an individual or a small team is far more likely to be overcome than one consisting of a large team, yet a large team is unlikely to be posted at an out-of-the-way location. Thus, the use of a guard is only partially effective at best.

Also, members of a guard may be subverted. This is more likely to occur with an individual or a small team than a large team, yet an individual or a small team is precisely the type of guard to be posted at a seldom-used structure entrance.

Another problem associated with guards is that guards are expensive. Wages, benefits, insurance, taxes, and training expenses can become a significant portion of a security budget.

An alternative method of providing security for secondary structure entrances is the use of a central guard. Such a guard is typically a large team maintained in a centralized location (a guard room). By being a large team, the guard suffers minimally from ennui. Also, by being a large team in a central location, the guard may be of sufficient strength to oppose an aggressor at any of a plurality of locations throughout the facility. However, the central location may be some distance away from secondary structure entrances, and a significant delay may occur before a central guard can detect and respond to an assault at a remote secondary structure entrance. Accordingly, it would be desirable if vestibular passways were provided for secondary structure entrances, and if such passways were constructed so as to delay ingress until a remotely located guard could arrive.

Several problems occur in the construction and implementation of vestibular security entrance passways. A passway to protect an existing structure entrance is conventionally constructed at the location it is to be used. This approach is often excessively expensive and insecure. An immediate and obvious difficulty lies in dealing with multiple venders to achieve construction. A first contractor, for example, may construct the security doors, a second contractor may construct the doorframes, a third contractor may construct the vestibule itself, and a fourth contractor may oversee the construction and integration of the components. Often, such multiple-vender scenarios lead to confusion and delays.

Quality control poses yet another problem. Security doors and passways desirably meet stringent quality-control requirements, e.g., material types and grades, explosion resistance, etc. Failing to meet specific requirements effectively compromises the entire vestibular entrance passway. With local contractors providing both materials and construction, it becomes very difficult to maintain quality control.

Additionally, the construction of such entrance passways is subject to active and passive sabotage. Sabotage occurs when actions are taken that compromise the integrity of the passway under construction. Active sabotage occurs when the individual(s) committing such actions intend to compromise passway integrity. Passive sabotage occurs when that passway integrity is compromised even though the individual(s) committing such action possess no such intent. In either case, sabotage is committed and the entrance passway fails to provide proper protection.

What is needed, therefore, is a vestibular entrance passway constructed off-site, where quality control and security can be maintained and where all standards can be met. This vestibular entrance passway should, when in position, severely inhibit ingress of an existing structure entrance by a highly trained, well-equipped aggressor, so as to delay ingress sufficiently to allow the arrival of armed guards from a central location.

SUMMARY OF THE INVENTION

Accordingly, it is an advantage of the present invention that a penetration-resistant security passway and door are provided.

Another advantage of the present invention is that ingress through the provided passway is impeded to a degree sufficient to allow a central guard to respond.

Another advantage of the present invention is that a plurality of passive devices is provided to effect that impediment to passage.

Another advantage of the present invention is that the passway includes a concrete vestibule manufactured off-site at a location where quality control can be ensured.

Another advantage of the present invention is that a security door is provided for the vestibule that actively reacts to inhibit the passage of an aggressor through that door and the vestibule.

These and other advantages of the present invention are provided in one form by a penetration-resistant modular security passway configured to secure a structure entrance. The passway comprises a concrete vestibule coupled to the structure entrance and controlling passage therethrough. The vestibule is fabricated of concrete into which a plurality of reinforcing members has been cast, and includes a means for engagement of a lifting mechanism to facilitate movement of the vestibule. The passway additionally comprises a penetration-reactive security door affixed to the concrete vestibule and controlling access thereto.

These and other advantages of the present invention are additionally provided by a penetration-resistant security passway door comprising a substruction having a first face, a second face, an inside periphery, and a space within said inside periphery. The door also comprises a first cladding affixed to the first face, a second cladding affixed to the second face, and a metallic cable strung throughout the space and coupled to the inside periphery at a plurality of locations.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

The present invention utilizes a penetration-resistant modular security passway to inhibit access to an entrance of a sensitive structure, hence inhibit ingress into that structure, for a period of time sufficient to allow an armed guard to respond to an assault by a skilled and well-trained aggressor. A presumption is made that the aggressor may effect the assault by means of explosive devices.

Figure 1:
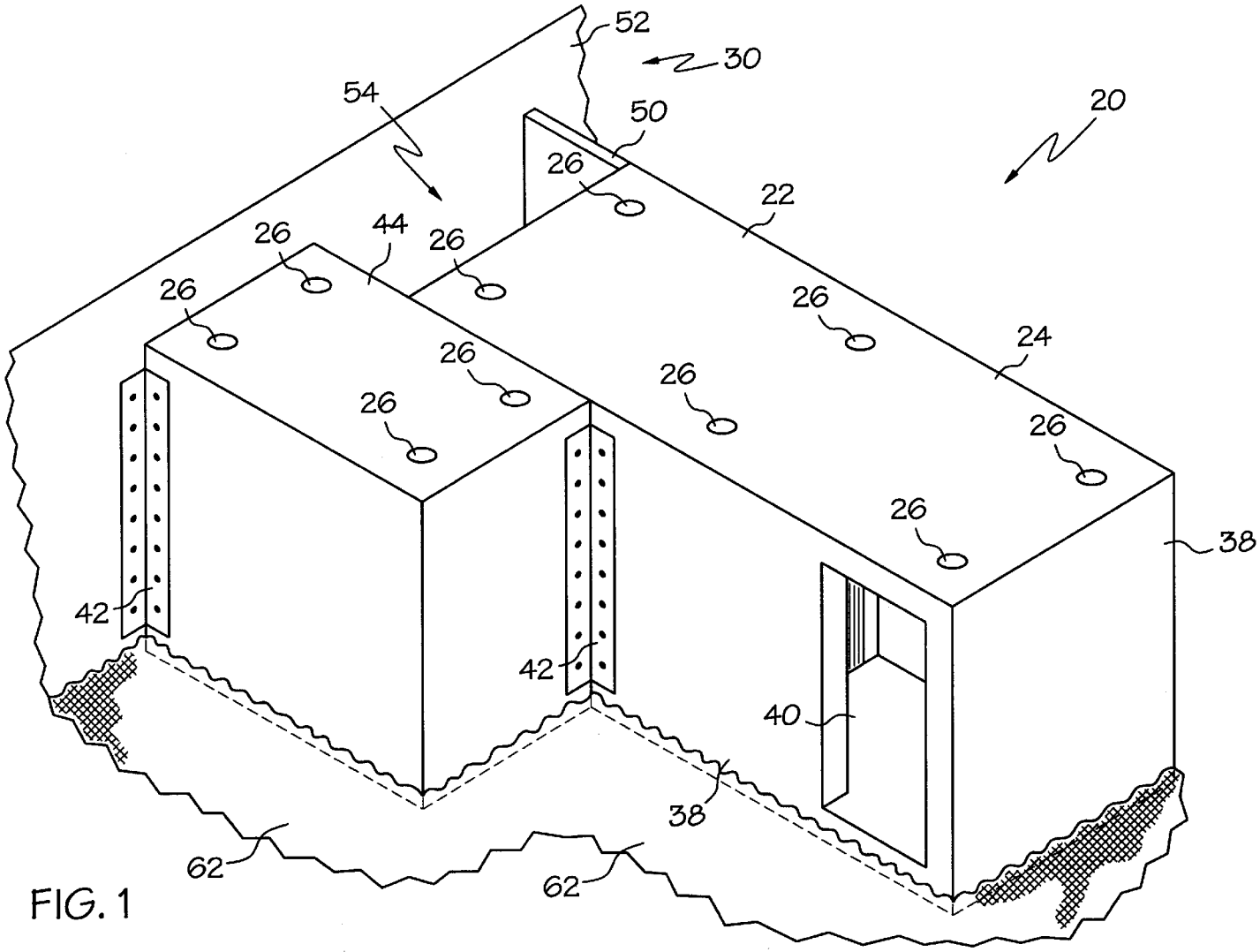
FIG. 1 depicts an isometric view of a penetration-resistant modular security passway in accordance with a preferred embodiment of the present invention.
Figure 2:
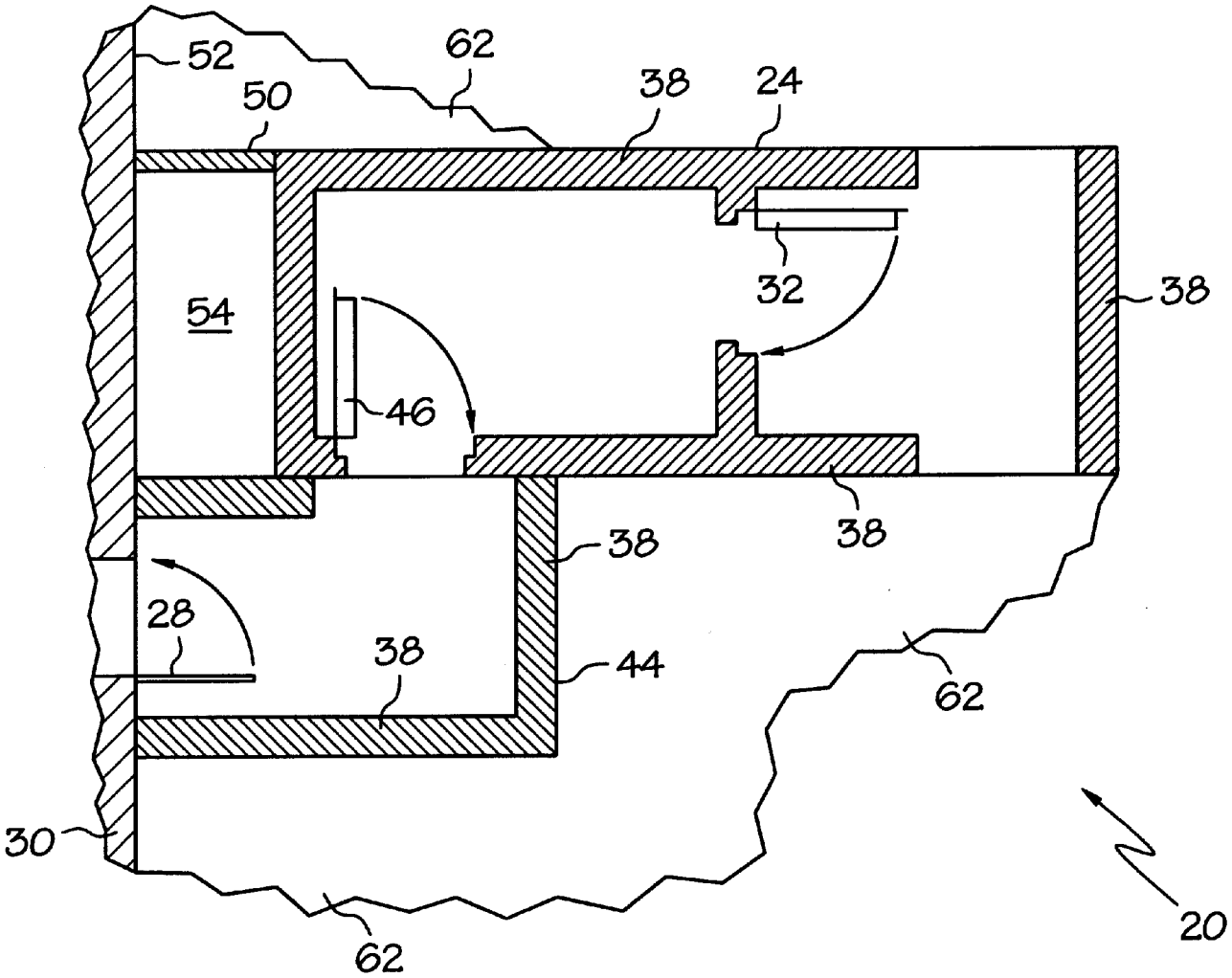
FIG. 2 depicts a floorplan of the modular security passway depicted in FIG. 1 in accordance with a preferred embodiment of the present invention.
Figure 3:
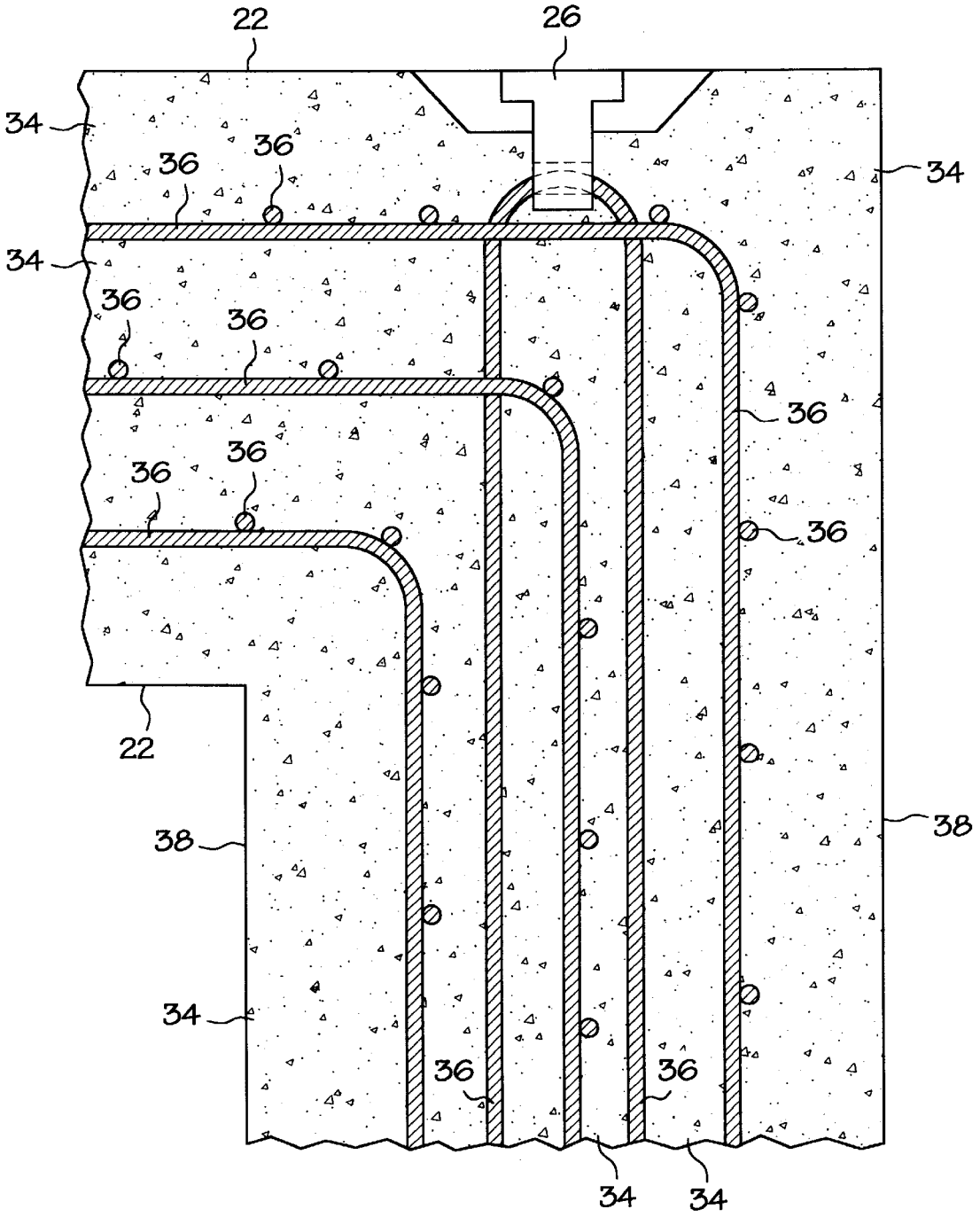
FIG. 3 depicts a vertical sectional view through a portion of a roof of a concrete vestibule illustrating a lifting lug in accordance with a preferred embodiment of the present invention.

FIG. 1 depicts an isometric view of a penetration-resistant modular security passway 20, FIG. 2 depicts a floorplan of passway 20, and FIG. 3 depicts a vertical sectional view through a portion of a roof 22 of a concrete vestibule 24 illustrating a lifting lug 26, in accordance with a preferred embodiment of the present invention. The following discussion refers to FIGS. 1 through 3.

Penetration-resistant modular security passway 20 secures a vulnerable entrance 28 to a sensitive structure 30 by means of concrete vestibule 24 to which a penetration-reactive security door 32 is affixed. Vestibule 24 is an explosion-resistive structure fabricated of concrete 34 into which reinforcing members 36 are cast. In the preferred embodiment depicted in FIG. 3, reinforcing members 36 are multiple layers of rebar netting cast into each wall 38, floor 40, and roof 22 of vestibule 24, forming a rebar endoskeleton onto which concrete 34 is cast. Those skilled in the art will appreciate that other methods of providing suitable reinforcement of vestibule 24 may be used without violating the intent and requirements of the present invention.

Vestibule 24 is desirably locatable (i.e., transportable) in that it is fabricated off-site, at a location where appropriate security and quality control may be maintained, then moved to the required location and coupled to structure entrance 28. In the preferred embodiment depicted in FIG. 1, vestibule 24 is of a size and mass (approximately 8'×21'×10' and less than 150,000 lbs.) so that locatability may be effected via truck, rail, ship, and/or aircraft as required.

Vestibule 24 is equipped with multiple lifting lugs 26 embedded within roof 22. Lifting lugs 26 provide a means by which a crane or other suitable lifting mechanism (not shown) may effect locatability. Essentially, vestibule 24 is lifted into place via a crane and coupled to structure entrance 28. In the preferred embodiment depicted in FIG. 1, vestibule 24 is bolted into position utilizing anchor plates 42. Those skilled in the art will appreciate, however, that anchor plates 42 are not required for vestibule 24 to fulfill the requirements of the present invention, and that the mass of vestibule 24 alone is generally sufficient to keep passway 20 in position once so located.

Once located, vestibule 24 controls access to and passage through structure entrance 28, with security door 32 controlling access to and passage through vestibule 24 in turn. Vestibule 24 is locatable, rather than movable, in that it is generally not moved once placed in position, though should the need arise, lifting lugs 26 may be used to remove or relocate vestibule 24.

In the preferred embodiments depicted in FIGS. 1 and 2, an inner vestibule 44 is also locatable. Inner vestibule 44 is fabricated off-site, moved to the required location by truck, train, ship, and/or aircraft, and coupled to structure entrance 28. Like outer vestibule 24, inner vestibule 44 is equipped with multiple lifting lugs 26.

In the preferred embodiment depicted in FIGS. 1, and 2, passway 20 is depicted with vestibule 24 being outer vestibule 24 coupled to structure entrance 28 through inner vestibule 44. Inner vestibule 44 is similar to outer vestibule 24 in construction, having roof 22, walls 38, and floor 40 fabricated of concrete 34 into which reinforcing members 36 are cast. Security door 32 is an outer security door 32 controlling access to and passage through outer vestibule 24. Outer vestibule 24 also has an inner security door 46 essentially identical to outer security door 32. Inner security door 46 controls passage between outer vestibule 24 and inner vestibule 44. Inner vestibule 44 controls access to and passage through structure entrance 28.

Figure 4:
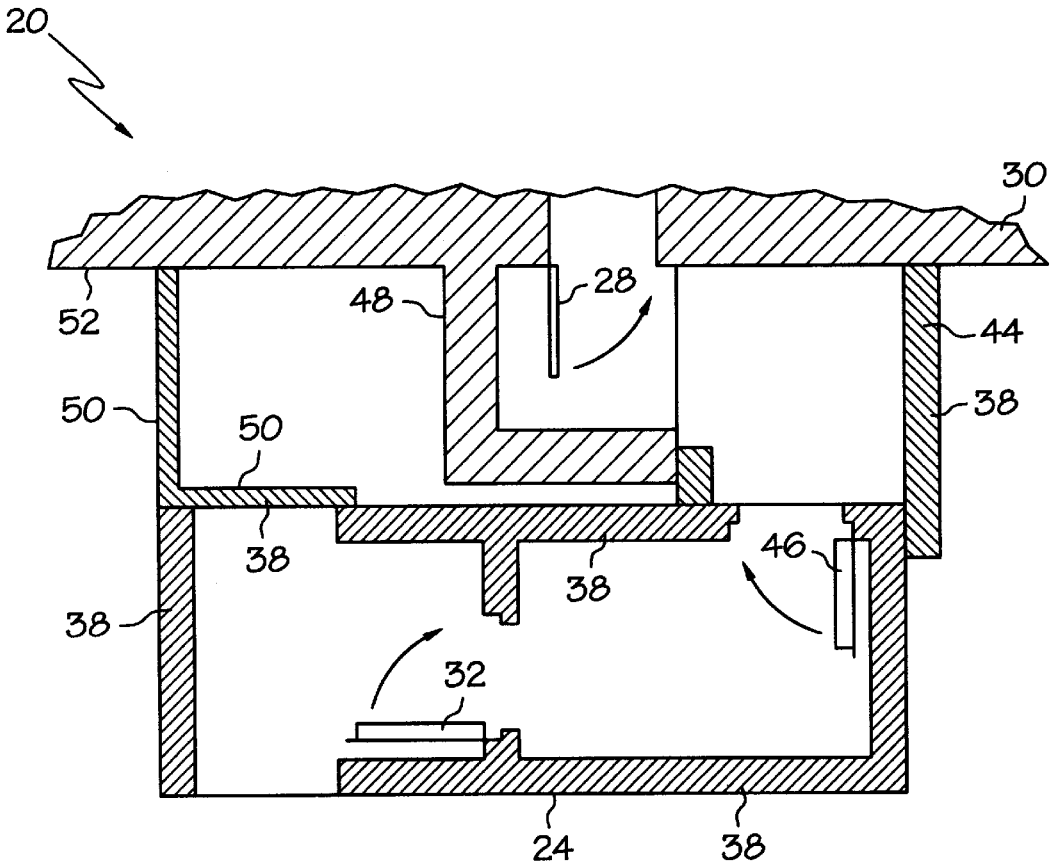
FIG. 4 depicts a floorplan of a modular security passway formed of an outer vestibule coupled with a site-built inner vestibule in accordance with an alternative embodiment of the present invention.

FIG. 4 depicts a floorplan of modular security passway 20 formed of an outer vestibule 24 coupled with a site-built inner vestibule 44 in accordance with an alternative embodiment of the present invention. The following discussion refers to FIGS. 1, 2, and 4.

In the alternative embodiment depicted in FIG. 4, structure 30 has a porch 48 surrounding entrance 28 so as to preclude the installation of a locatable inner vestibule 44. In such a case, those skilled in the art will recognize that inner vestibule 44 is desirably constructed on-site. Care is desirably taken so that site-built inner vestibule 44 meets or exceeds the quality standards of an inner vestibule constructed off-site.

In the embodiments depicted in FIGS. 2 and 4, inner security door 46 is directly affixed to outer vestibule 24. Inner security door 46 may be directly affixed to inner vestibule 44 with no loss in security or functionality. Affixing inner security door 46 to outer vestibule 24, however, prevents any potential misalignment of inner vestibule 44 and outer vestibule 24 from interfering with the operation of inner security door 46.

In the embodiments depicted in FIGS. 1, 2, and 4, a security wall 50 is so placed as to enclose an airspace between vestibule 24 and an existing wall 52 of structure 30. The purpose of security wall 50 is to prevent an aggressor from effecting concealment within an airspace 54, and/or gaining access to wiring, etc., contained within airspace 54. Those skilled in the art will appreciate that the purpose of security wall 50 is ancillary to the purposes of the present invention. The omission of security wall 50 does not affect the purposes of the present invention.

Figure 5:
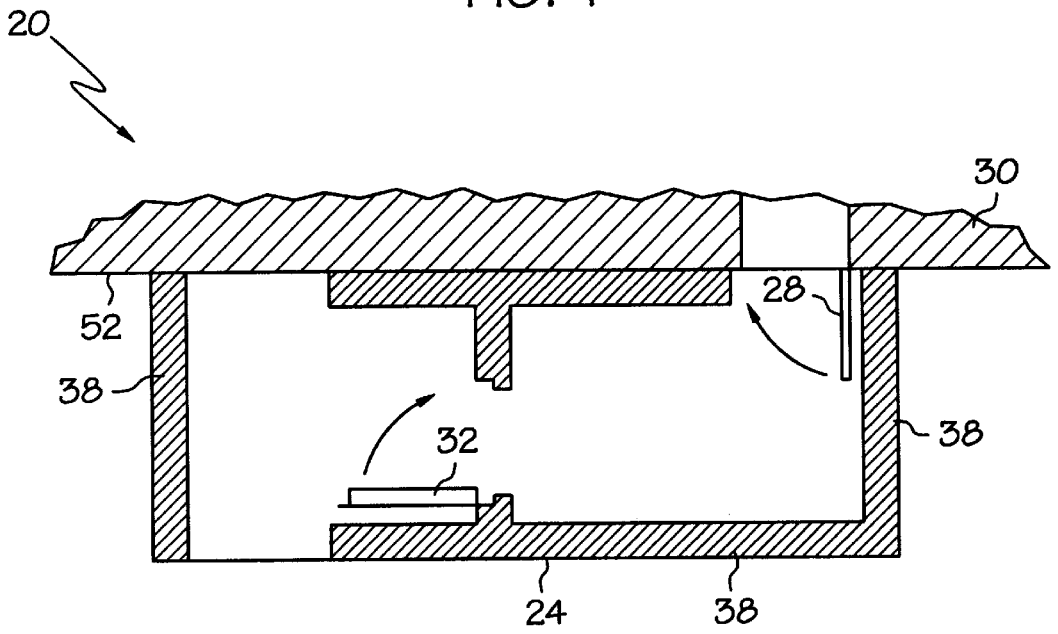
FIG. 5 depicts a floorplan of a modular security passway formed of a single vestibule in accordance with another alternative embodiment of the present invention.

FIG. 5 depicts a floorplan of modular security passway 20 formed of a single vestibule 24 in accordance with another alternative embodiment of the present invention. The following discussion refers to FIG. 5.

In the alternative embodiment depicted in FIG. 5, vestibule 24 is coupled directly to structure entrance 28. This is a single-vestibule embodiment having only security door 32 (inner door 46 having been left off). This single-vestibule embodiment provides less security than a preferred dual-vestibule embodiment, and would be used where a dual-vestibule embodiment is not practical, e.g., where there is a space restriction. A significant improvement in security over an unprotected (hence, vulnerable) structure entrance 28 is still provided by this embodiment.

Those skilled in the art will recognize that varying numbers of vestibules 24 having varying numbers of security doors 32 may be used according to circumstances. For example, a single-vestibule passway 20, as depicted in FIG. 5, may be used where space prohibits a dual-vestibule passway 20. Similarly, a triple-vestibule passway 20 (not shown) may be used where appropriate security requires a longer ingress time delay.

Figure 6:
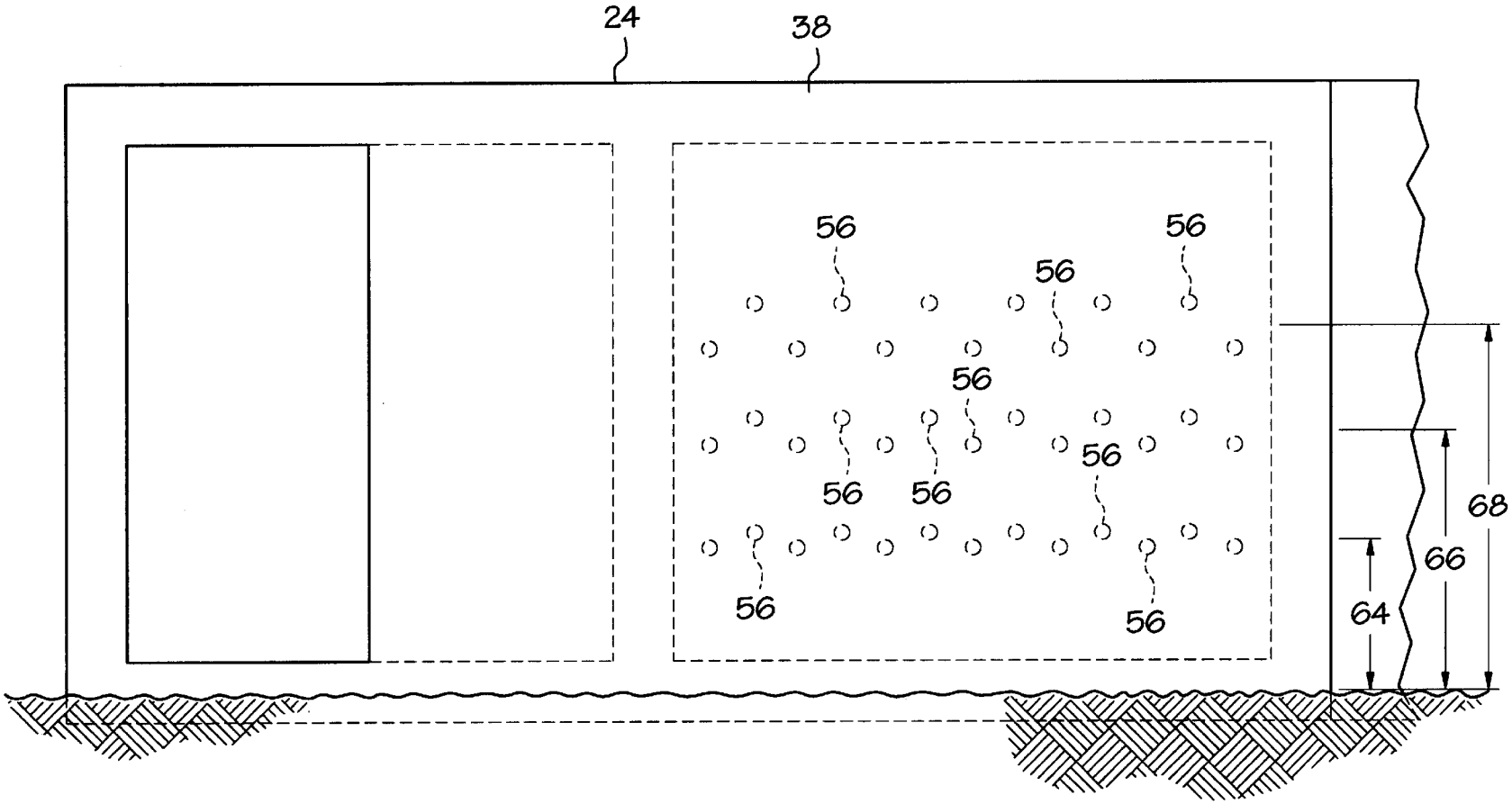
FIG. 6 depicts an elevation view of a wall of a concrete vestibule showing locations of passive antipersonnel devices embedded within that wall in accordance with a preferred embodiment of the present invention.
Figure 7:
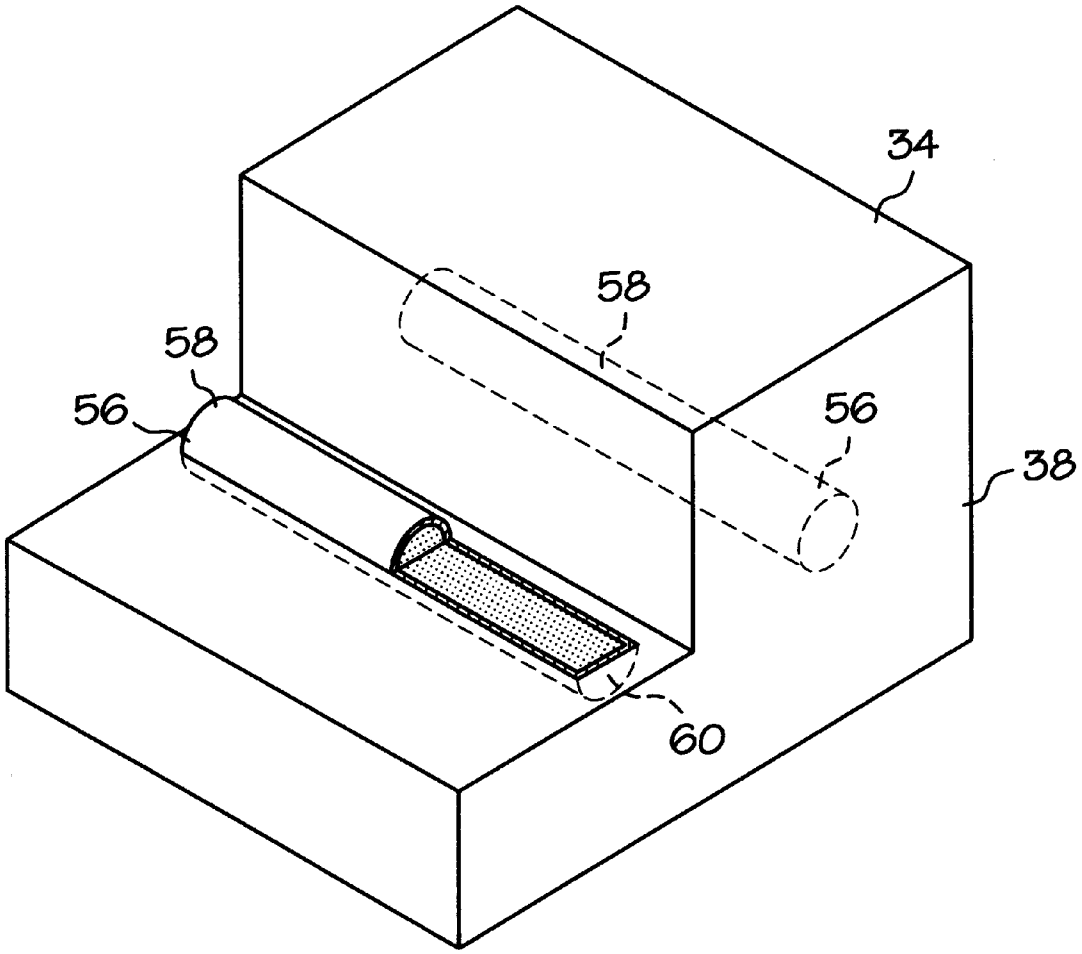
FIG. 7 depicts an isometric cross-sectional view of a portion a wall of a concrete vestibule showing passive antipersonnel devices within that wall in accordance with a preferred embodiment of the present invention.

FIG. 6 depicts an elevation view of wall 38 of concrete vestibule 24 showing locations of passive antipersonnel devices 56 embedded within wall 38, and FIG. 7 depicts an isometric cross-sectional view of a portion of wall 38 showing passive antipersonnel devices 56 within wall 38, in accordance with a preferred embodiment of the present invention. The following discussion refers to FIGS. 1, 2, 6, and 7.

As depicted in the preferred embodiment, vestibule 24 may be an explosion-reactive vestibule. Passive antipersonnel devices 56 are embedded crosswise within walls 38 of vestibule 24. Antipersonnel devices 56 consist of cylinders 58 containing fléchettes (or other projectiles) 60. Cylinder 58 is slightly shorter than wall 38 is thick, e.g., 10½–11" long for a 12" wall, leaving a small amount of concrete 34 covering each end of cylinder 58. In the event of an explosive assault breaching vestibule 24, the location of each cylinder 58 provides a weak spot in wall 38. The pressure created within vestibule 24 by the explosive assault causes concrete 34 at each end of cylinder 58 to fracture and propels fléchettes 60 outward into an external area 62 adjacent to wall 38 (see FIGS. 1 and 2). To produce a maximum antipersonnel effect, passive antipersonnel devices 56 are arranged within walls 38 in three staggered rows at approximately a knee height 64, a chest height 66, and a head height 68. The reactions of vestibule 24 and antipersonnel devices 56 to an explosive breaching assault are discussed in greater detail later.

Antipersonnel devices 56 are passive, i.e., fléchettes 60 are propelled outward only by the pressure created within vestibule 24 by an explosive assault. Passive devices 56 are used as a safety measure. Unlike active devices, such as mines, passive devices have no internal energization source to risk the injury or death of innocents. For example, were a forklift being operated for legitimate reasons in external area 62 and accidentally bump wall 38 at the location of a passive device, that device will not be activated and cannot injure the forklift operator.

Those skilled in the art will appreciate that antipersonnel devices 56 of other types and in other arrangements may be utilized without departing from the scope, function, or intent of the present invention.

Figure 8:
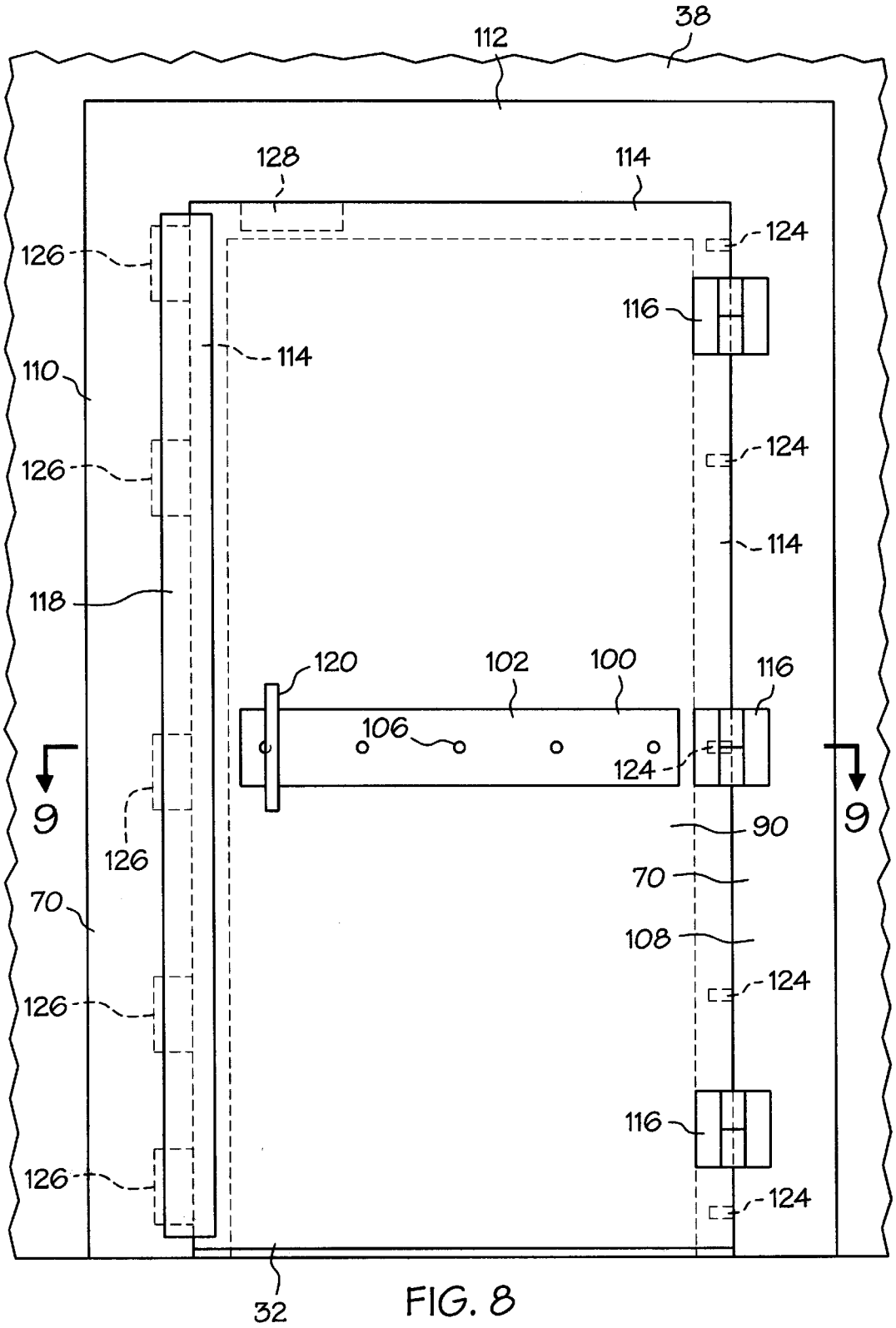
FIG. 8 depicts an elevation view of a penetration-reactive security door closed within a doorframe therefor in accordance with a preferred embodiment of the present invention.
Figure 9:
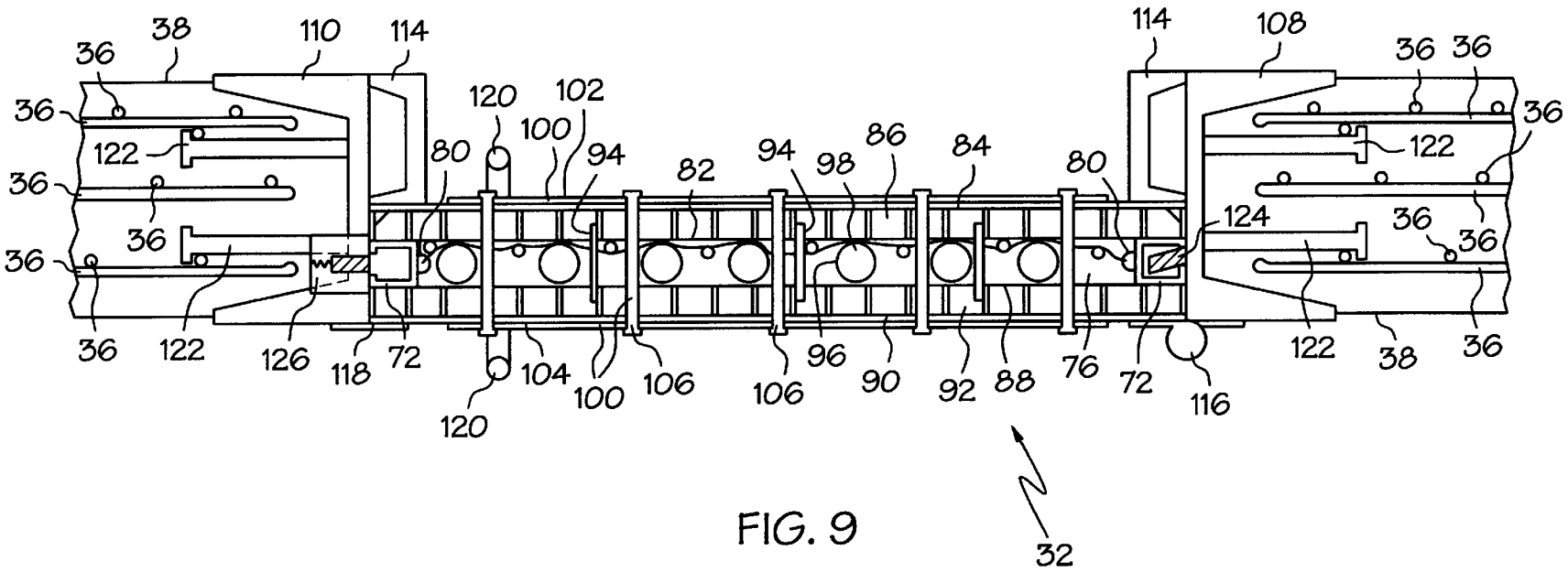
FIG. 9 depicts a horizontal cross-sectional view through a portion of wall of a concrete vestibule encompassing the door and doorframe depicted in FIG. 8 at a midpoint of that door in accordance with a preferred embodiment of the present invention.
Figure 10:
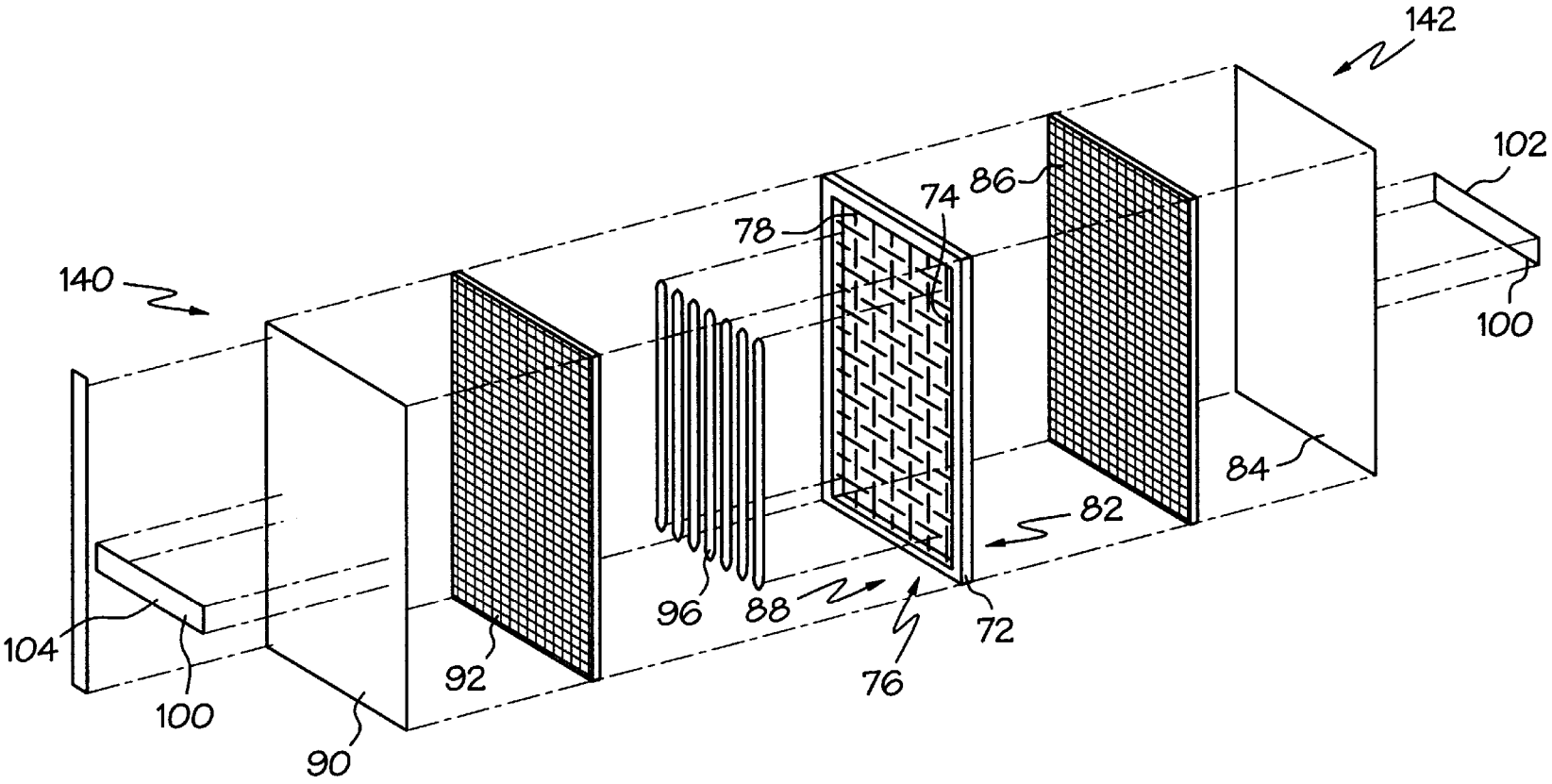
FIG. 10 depicts an anisometric exploded view of a penetration-reactive security door in accordance with a preferred embodiment of the present invention.

FIG. 8 depicts an elevation view of penetration-reactive security door 32 closed within a doorframe 70, FIG. 9 depicts a horizontal cross-sectional view through a portion of wall 38 of concrete vestibule 24 encompassing door 32 and doorframe 70 at a midpoint of door 32, and FIG. 10 depicts an anisometric exploded view of door 32. Being substantially identical to each other, both outer and inner security doors 32 and 46 are identified as security door 32 in the following discussion, which refers to FIGS. 8, 9, and 10.

Security door 32 includes a substruction 72, being a frame to which other components of door 32 are directly or indirectly affixed. Substruction 72 has an inside periphery 74 enclosing a space 76. A metallic (e.g., steel) cable 78 is strung throughout space 76 and coupled to inside periphery 74 via cable attachment devices (e.g., eyehooks) 80 at a plurality of locations. Cable 78 is strung and tightened by hand and is essentially woven into a loose net. The purpose of cable 78 is to increase the strength of substruction 72 and to delay the torsional expansion of substruction 72 in the event of an explosive breach of door 32, thus inducing door 32 to expand within doorframe 70 so as to jam therein, rather than twist outward therefrom. The jamming of door 32 into doorframe 70 is desirable because it impedes the passage of an aggressor through door 32 and inhibits ingress to sensitive structure 30.

Substruction 72 has an inner face 82 to which an inner cladding 84 is affixed. Between inner face 82 and inner cladding 84 is affixed an inner grate 86. Similarly, substruction 72 has an outer face 88 to which an outer cladding 90 is affixed. Between outer face 88 and outer cladding 90 is affixed an outer grate 92.

In the preferred embodiment, inner and outer claddings 84 and 90 are fabricated of armor plate so as to provide a resistance to penetration of door 32. The characteristics of armor plate are such that, once sufficient force is applied to effect penetration, it sustains a marked deformation. This deformation is especially severe if the penetration breaches door 32. In such a case, the portions of claddings 84 and 90 proximate the breach are bent outward in jagged and sharp sheets and ribbons of materiel. This jaggedness poses a risk of injury to an aggressor attempting to effect passage, hence impeding that passage and inhibiting ingress to sensitive structure 30.

Inner and outer grates 86 and 92 are fabricated of a frangible material (e.g., high-carbon steel) so as to add considerably to the overall strength of door 32 and to fracture upon an explosive breach of door 32. This leaves sharp edges and points to the portions of grates 86 and 92 proximate the breach. An aggressor coming in contact with these edges and points risks serious injury. Additionally, those portions of grates 86 and 92 fractured by the explosive breach become debris with sharp edges and points. A significant portion of this debris scatters around vestibule 24 and remains upon floor 40. An aggressor attempting to effect passage through door 32 and vestibule 24 is thus impeded in that attempt by having to avoid injury from those sharp edges and points, both in the breach in door 32 itself and in the debris on floor 40. The reactions of door 32 to an explosive breaching assault are discussed in more detail later.

In the preferred embodiment, substruction 72, inner and outer grates 86 and 92, and inner and outer cladding 84 and 90 are welded together to form a unitary construction. Inner cladding 84 is affixed (welded) to inner grate 86 along all edges and at a plurality of inner locations. Inner grate 86 is affixed (welded) to inner face 82 of substruction 72 along all edges. A plurality of inter-grate attachment devices (e.g., strips of armor-plate) 94 is affixed (welded) to inner grate 86 at a plurality of inner locations so as to protrude through space 76 and into the area to be occupied by outer grate 92. Outer grate 92 is affixed (welded) to outer face 88 of substruction 72 along all edges, and is affixed (welded) to each inter-grate attachment device 94 so as to be affixed to inner grate 86 through space 76. Finally, outer cladding 90 is affixed (welded) to outer grate 92 along all edges. The resultant security door 32 is unitary in construction and possesses significant resistance to penetration or breachment. The reactions of door 32, of grates 86 and 92, and of claddings 84 and 90 to a penetrating or breaching assault are discussed later.

In the present invention, security door 32 is a penetration-reactive security door in that upon an assault causing penetration or breachment, door 32 reacts swiftly and potentially violently to inhibit passage of an aggressor through door 32 and subsequent ingress into vestibule 24. This penetration-reactive characteristic is provided at least in part by a plurality of individually sealed tubes 96 suspended within space 76 of substruction 72 and containing a foaming agent 98 under pressure. Tubes 96 are positioned within space 76 in such a manner that a breach of door 32 of a size sufficient to pass materiel (e.g., a second explosive charge) through door 32 will fracture at least one tube 96 and release foaming agent 98 contained therein. Tubes 96 are individually sealed so that a breach of door 32 releasing foaming agent 98 from one or more tubes 96 leaves some tubes 96 intact and able to release additional foaming agent 98 in the event of a second breach of door 32.

Tubes 96 are fabricated of stainless steel. This is done in order to prevent the inadvertent fracturing of tubes 96 in the event of accident, while maintaining chemical neutrality with regard to foaming agent 98. Were tubes 96 fabricated of a frangible material (e.g., glass), they would be susceptible of breakage in the event of a severe jarring of door 32. This would pose a hazard to an innocent involved in the jarring and decrease the effectiveness of door 32 as a security door.

Foaming agent 98 is a highly expansive, highly adhesive foaming agent, such as STICKY FOAM™, developed by Sandia National Laboratories and produced by Allied Signal Corp. The reactions of door 32, tubes 96, and foaming agent 98 to a penetrating or breaching assault are discussed later.

Door 32 may additionally have a girdle 100 affixed across door 32 horizontally at an approximately centered vertical dimension. Girdle 100 includes an inner reinforcement plate 102 affixed to an outside of inner cladding 84, and an outer reinforcement plate 104 affixed to outer cladding 90. Inner and outer reinforcement plates 102 and 104 are affixed to each other by a plurality of inter-plate attachment devices 106 passing through door 32.

In the preferred embodiment, inner and outer reinforcement plates 102 and 104 are fabricated of armor plate and affixed to inner and outer cladding 84 and 90 by peripheral welding. Inter-plate attachment devices 106 are Nelson studs passing through door 32 and affixed to inner and outer reinforcement plates 102 and 104 by welding. The use of girdle 100 significantly increases the strength of door 32 and inhibits the disassembly of door 32 during an explosive assault. The reactions of door 32 and of girdle 100 to a breaching assault are discussed in greater detail later.

Security door 32 is affixed to vestibule 24 by a doorframe 70 (see FIGS. 8 and 9). Doorframe 70 has a hinge jamb 108, a strike jamb 110, and a lintel 112. Door 32 abuts against a doorstop 114 when in a closed position. Doorstop 114 is affixed or formed within doorframe 70 as parts of hinge jamb 108, strike jamb 110, and lintel 112. Door 32 is hung from hinge jamb 108 by hinges 116. Door 32 has a pickplate 118 which conceals the junction between door 32 and strike jamb 110 when door 32 is in a closed position. Door 32 is opened and closed by means of handles 120 (FIG. 9).

In the preferred embodiment, hinge jamb 108, strike jamb 110, and lintel 112 are constructed of "C" beams affixed to reinforcing members 36 within wall 38 of vestibule 24. This is accomplished, as depicted in FIG. 9, by a plurality of studs (Nelson studs) 122 welded to the insides of jambs 108 and 110 and welded to reinforcing members (rebar) 36 prior to the casting of concrete 34. Doorframe 70 is thus firmly and rigidly affixed to vestibule 24. Doorstop 114 is depicted as being constructed of secondary "C" beams affixed to and within doorframe 70. Those skilled in the art will appreciate that this is but one of numerous manners in which doorframe 70 may be constructed and firmly and rigidly affixed to vestibule 24. Other construction and affixation manners may be utilized without departing from the function of the present invention.

Referring to FIGS. 8 and 9, a plurality of studs 124 is affixed to an outer surface of doorframe 70 so as to protrude into an edge of door 32 when door 32 is closed. Similarly, a plurality of remotely actuated electric deadbolts 126 is affixed to an outer surface of doorframe 70 so as to protrude into an edge of door 32 when door 32 is in a closed position and electric deadbolts are extended.

In one exemplary scenario, electric deadbolts 126 in strike jamb 110 are be configured so as to be retracted when power is applied. In the event of a security alert, power can then be removed from deadbolts 126, causing automatic extension into door 32 and, in conjunction with studs 124 on hinge jamb 108, firmly and securely lock door 32 within doorframe 70. Since, in this scenario, deadbolts 126 would be normally retracted, door 32 would be free to be opened and closed for normal passage of personnel and materiel. Door 32 is latched and unlatched for normal use via a magnetic latch 128 (FIG. 8).

Those skilled in the art will appreciate that the above latching scenario is not fundamental to the purposes and intents of the present invention, and that other latching scenarios may be used, especially in areas governed by specific safety and fire restrictions.

Figure 11:
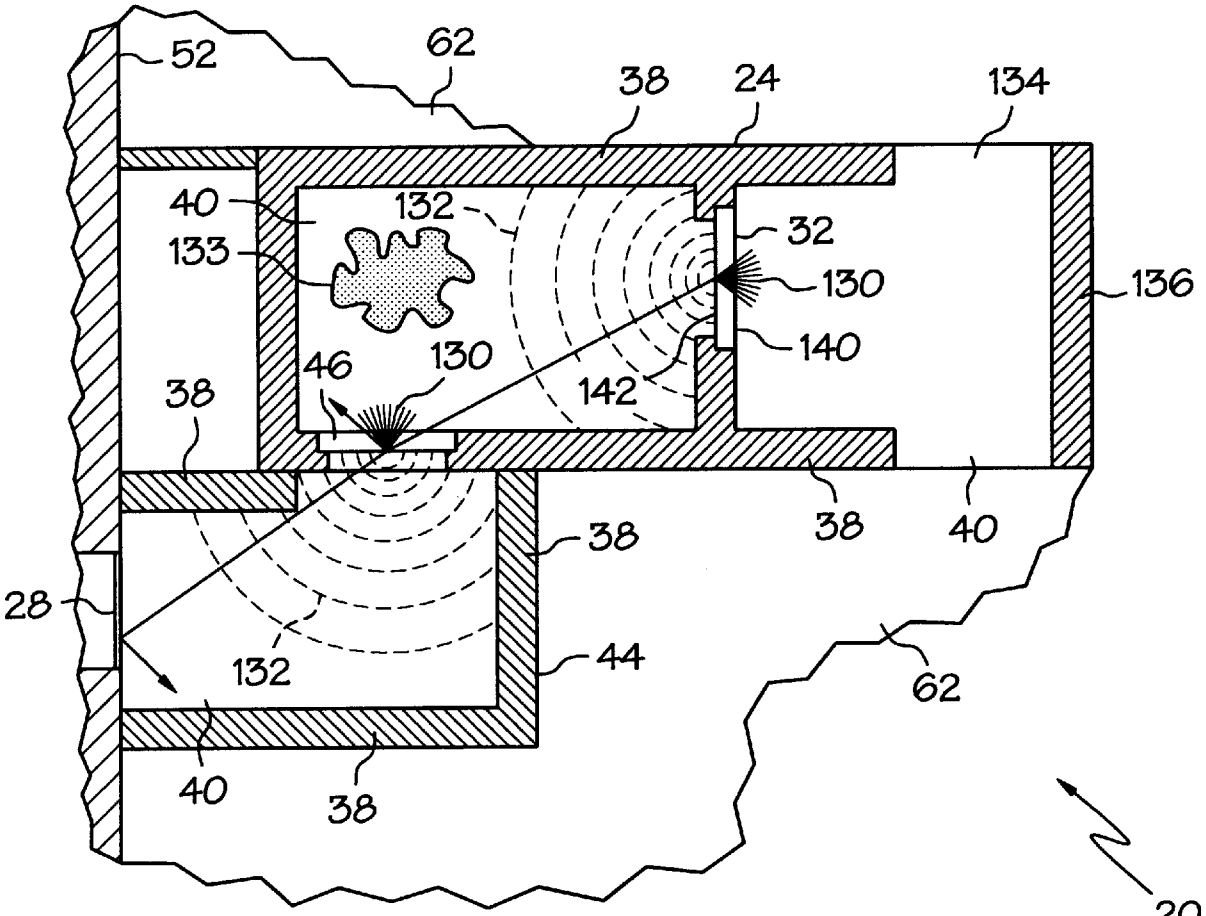
FIG. 11 depicts the modular security passway floorplan depicted in FIG. 2 demonstrating paths of shockwaves from a breachment of security doors in accordance with a preferred embodiment of the present invention.
Figure 12:
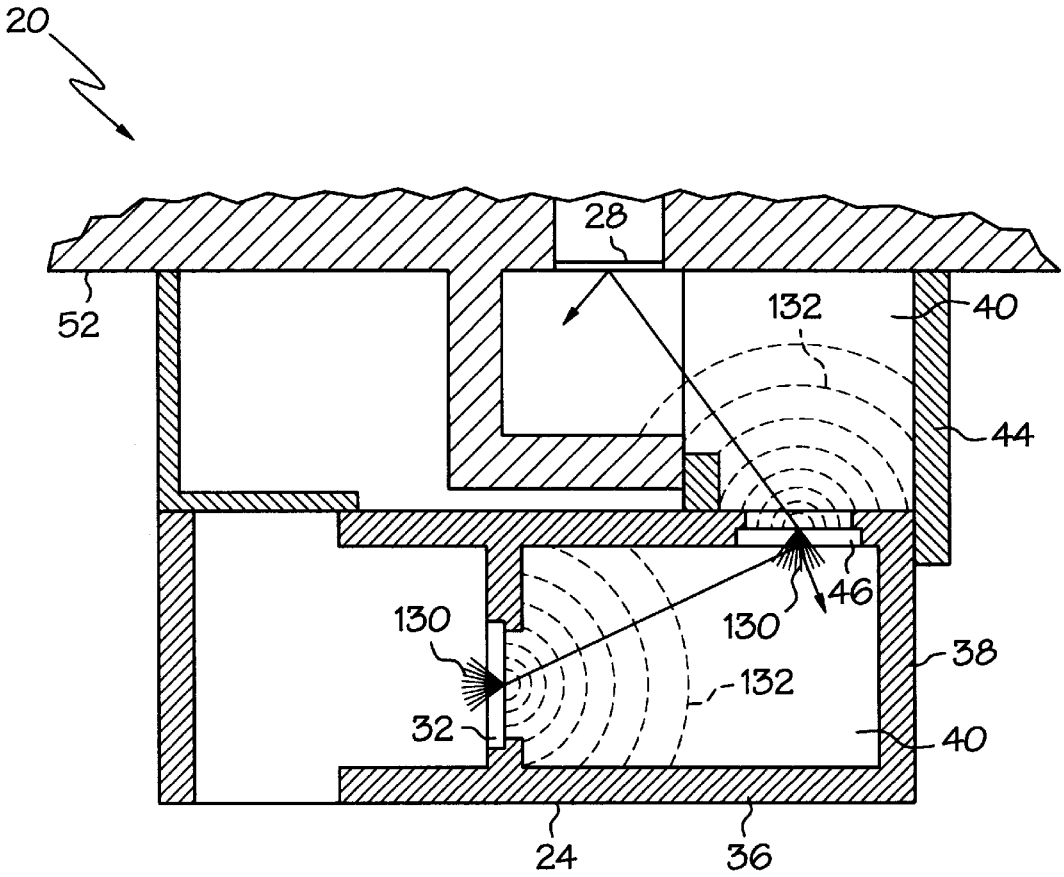
FIG. 12 depicts the modular security passway floorplan depicted in FIG. 5 demonstrating paths of shockwaves from a breachment of security doors in accordance with an alternative embodiment of the present invention.
Figure 13:
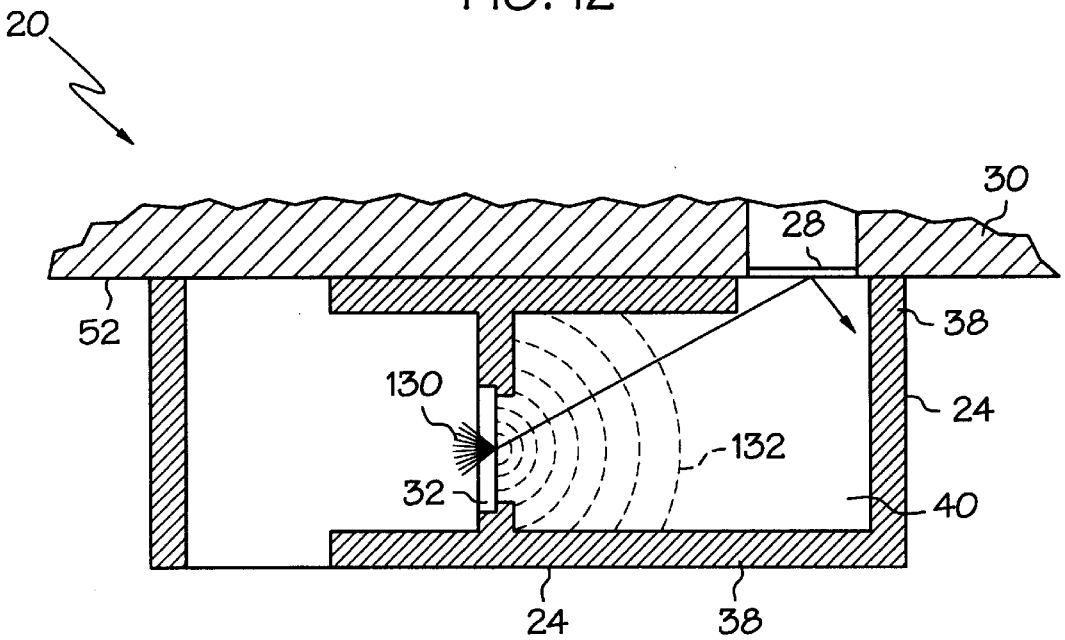
FIG. 13 depicts the modular security passway floorplan depicted in FIG. 6 demonstrating paths of shockwaves from a breachment of security doors in accordance with another alternative embodiment of the present invention.

FIG. 11 depicts the modular security passway floorplan depicted in FIG. 2, FIG. 12 depicts the modular security passway floorplan depicted in FIG. 4, and FIG. 13 depicts the modular security passway floorplan depicted in FIG. 5, each demonstrating paths of shockwaves 132 from a breachment of security doors in accordance with an embodiment of the present invention. The following discussion refers to FIGS. 11, 12, and 13.

In the event of an explosive assault by an aggressor against penetration-resistant modular security passway 20, hence against entrance 28 of sensitive structure 30, a plurality of passive and active reactions may occur. One such passive reaction is created by the configuration of passway 20 itself, i.e., as a result of the placement of security doors 32 and 46 relative to each other and relative to structure entrance 28.

If, in the preferred embodiments depicted in FIGS. 11 and 12, an explosive assault effects a penetration (breach) 130 of outer door 32, shock wave 132 propagates through outer vestibule 24. Outer door 32 is affixed to outer vestibule 24 in a location and position, relative to inner door 46 (FIGS. 11 and 12) so that shock wave 132 neither significantly nor perpendicularly assaults inner door 46. That is, shock wave 132 strikes inner door 46 only after dissipating to some significant degree and only at an oblique angle. This is accomplished by configuring passway 20 so that doors 32 and 46 are neither proximate nor opposite each other, i.e., they are separated and offset. This effect is most pronounced when doors 32 and 46 are positioned at substantially a right angle relative to each other. Hence, inner door 46 remains intact and passage through passway 20 is impeded, as is passage through entrance 28 and ingress into sensitive structure 30.

Likewise, inner door 46 (FIGS. 11 and 12) is affixed to outer vestibule 24 in a location and position, relative to structure entrance 28 so that shock wave 132 will neither significantly nor perpendicularly assault entrance 28. Hence, entrance 28 remains intact and passage through entrance 28 is impeded, as is ingress into sensitive structure 30.

Similarly, in the alternative embodiment depicted in FIG. 13, door 32 is affixed to vestibule 24 in a location and position, relative to structure entrance 28 so that shock wave 132 will neither significantly nor perpendicularly assault structure entrance 28. Hence, entrance 28 remains intact and passage through entrance 28 is impeded, as is ingress into sensitive structure 30.

Figure 14:
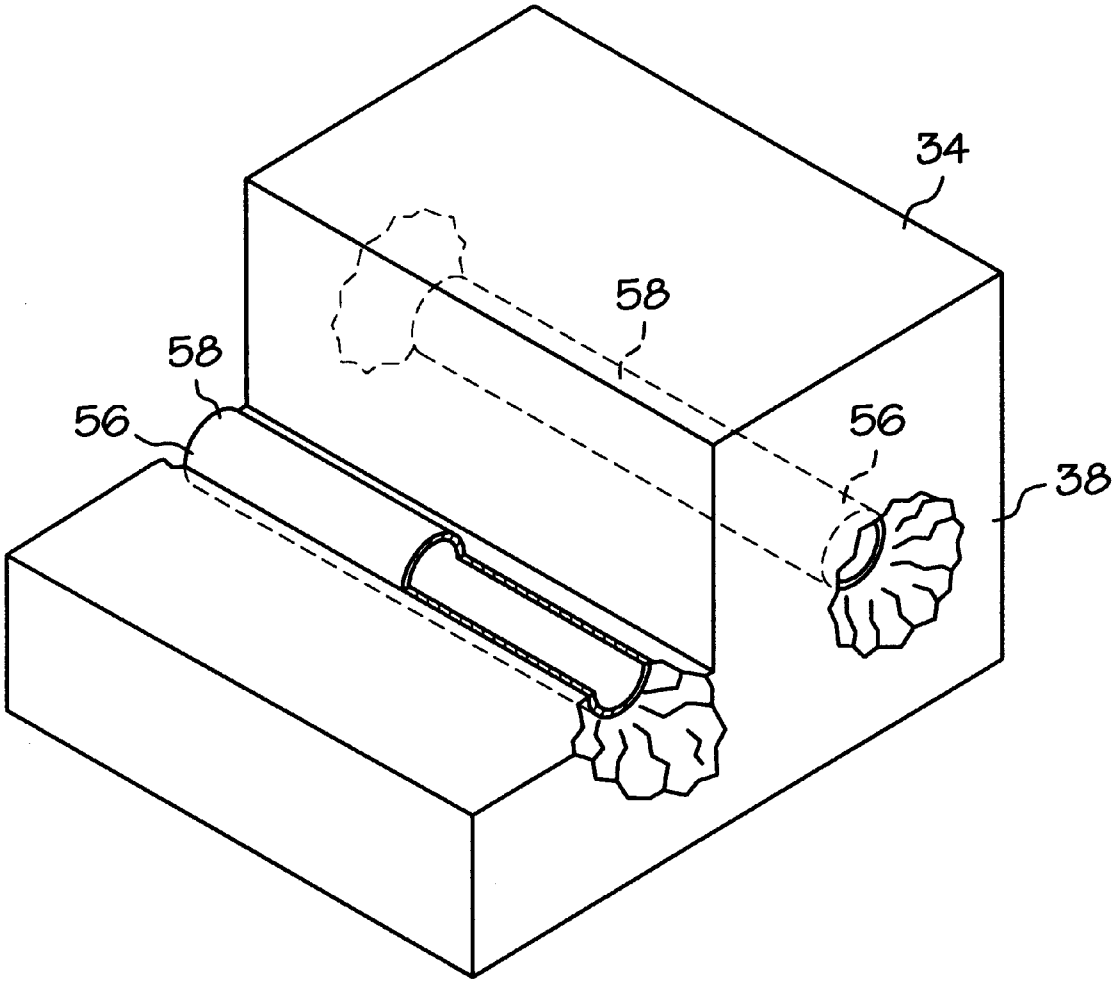
FIG. 14 depicts the vestibule wall portion and passive antipersonnel devices shown in FIG. 7 after an explosive assault has breached the concrete vestibule in accordance with a preferred embodiment of the present invention.

FIG. 14 depicts the portion of vestibule wall 38, and passive antipersonnel devices 56 embedded therein, of FIG. 7 after an explosive assault has breached vestibule 24. The following discussion refers to FIGS. 11 and 14. References to door 32 and vestibule 24 in this and subsequent discussions shall be taken to include inner door 46 and inner vestibule 44, as well as outer door 32 and outer vestibule 24.

If an explosive assault effects a penetration 130 of door 32 or vestibule 24, shock wave 132 propagates through vestibule 24, assaulting walls 38. The locations of embedded passive antipersonnel devices 56 (see FIG. 6) constitute weak spots in walls 38. The pressure created within vestibule 24 by shock wave 132 causes concrete 34 at each end of cylinder 58 to fracture and propels flechettes 60 (FIG. 7) outward into an external area 62 adjacent to wall 38. This action effectively incapacitates any aggressor within area 62. Hence, the ability of that aggressor to effect passage through passway 20 is impeded, as is passage through entrance 28, and ingress into sensitive structure 30.

If an explosive assault effects a penetration 130 of door 32 or vestibule 24, shock wave 132 propagates through vestibule 24 assaulting walls 38 and roof 22 (not shown). Shock wave 132 causes walls 38 and roof 22 to flex and expand. This in turn significantly spalls concrete 34, rendering a significant portion of walls 38 and roof 22 into debris 133. A portion of debris 133 then falls into vestibule 24 and occupies floor 40. In order to pass through vestibule 24, an aggressor would have to remove at least a portion of debris 133 from floor 40 in order to effect passage through vestibule 24. Hence, passage through passway 20 is impeded, as is passage through entrance 28 and ingress into sensitive structure 30.

Figure 15:
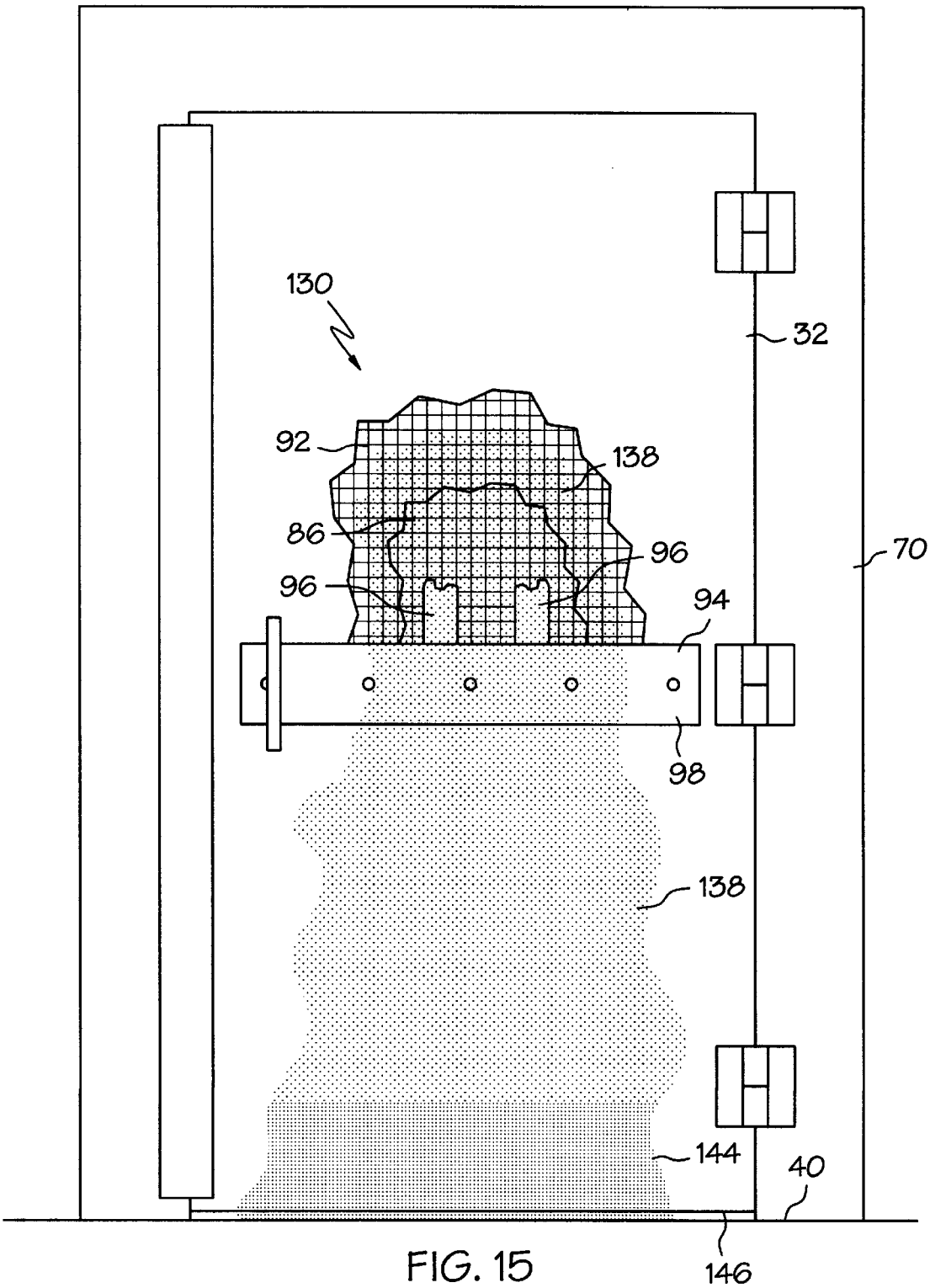
FIG. 15 depicts an elevation view of a breached door in accordance with a preferred embodiment of the present invention.

FIG. 15 depicts an elevation view of a breached door in accordance with a preferred embodiment of the present invention. The following discussion refers to FIGS. 10 and 15.

If an explosive assault effects a penetration 130 of door 32, a portion of door 32 is rendered into debris 133. Debris 133 is propelled into vestibule 24, where it, too, falls onto floor 40. Hence, passage through passway 20 is impeded, as is passage through entrance 28 and ingress into sensitive structure 30.

Metallic grates 86 and 92 are fabricated of materials of great strength, such as carbon steel, and form a significant part of the penetration resistance of door 32. When sufficient explosive force to effect penetration is applied to door 32, the nature of these materials is such that grates 86 and 92 fracture into debris 133 having a multitude of sharp edges and points, as do the portions of grates 86 and 92 remaining inside door 32 and framing breach 130. This makes the rendering of a portion of door 32 into debris 133 especially effective as a deterrent to passage. An aggressor has to navigate floor 40 of vestibule 24 while floor 40 is covered with debris 133. Debris 133 contains pieces of concrete which attempt to turn an ankle or otherwise direct a foot onto sharp, jagged pieces of metal waiting to slice into a boot and the foot therein, hence incapacitating the aggressor.

In the preferred embodiment, vestibule 24 is dimensioned so that the surface area of door 32 is greater than ten per cent of the surface area of floor 40. Therefore, the pressure created within vestibule 24 will be significant. This pressure promotes the creation of a considerable amount of debris 133 by the spalling of concrete 34. This spalling debris 133, together with debris 133 created by the rendering of door 32, will provide a significant coverage of floor 40. This coverage effectively impedes passage of an aggressor through vestibule 24 by being an unstable and dangerous surface upon which to attempt to walk. Hence, passage through passway 20 is impeded, as is passage through entrance 28 and ingress into sensitive structure 30.

Additionally, that portion of debris 133 which obstructs an inner door (i.e., inner door 46 or entrance 28) when an outer door (outer door 32 or inner door 46, respectively) was breached needs be removed before that inner door may be accessed and passage effected. If debris 133 is not removed, the inner door may not be easily opened or breached. Passage through the inner door is thus impeded, as is ingress into sensitive structure 30.

If an explosive assault effects a penetration 130 of door 32, shock wave 132 causes door 32 to attempt to distort and spring free of doorframe 70. Metallic cable 78 (FIGS. 9 and 10) impedes the torsional expansion of substruction 72 and induces door 32 to expand within doorframe 70 so as to jam therein. Hence, passage through door 32 is impeded, as is passage through passway 20, passage through entrance 28, and ingress into sensitive structure 30.

If an explosive assault effects a penetration 130 of door 32, shock wave 132 may cause door 32 to attempt to disassemble. Girdle 100, being fabricated of reinforcement plates 102 and 104 affixed to each side of door 32 and affixed to each other through door 32, adds significant additional strength to the midsection of door 32. Therefore, a portion of door 32 which might otherwise detach itself from the remainder of door 32 as a result of explosive penetration 130 may instead bend outward over girdle 100 (not shown). Hence, passage through door 32 is impeded, as is passage through passway 20, passage through entrance 28, and ingress into sensitive structure 30, by a sharp and jagged portion of outer cladding 90, and possibly outer grate 92, protruding outward over girdle 100. If the explosive assault is of sufficient strength to have completely disassembled door 32 were girdle 100 not present, then the aggressor would be faced with both an upper and a lower protrusion of torn and jagged outer cladding 90.

If an explosive assault effects a breach 130 of door 32, and a second explosive assault is made of door 32 by passing a large explosive charge through the breach and performing the second assault from inside vestibule 24, then the second explosive assault may cause door 32 to be blown free of doorframe 70 (not shown). In the preferred embodiment, vestibule 24 has a foyer outside door 32 and a strike wall 136 facing door 32. Therefore, door 32 is blown across foyer 134, collides with strike wall 136, and collapses into foyer 134. By these actions, door 32 has been rendered into a significant quantity of debris 133 obstructing foyer 134. Debris 133 inhibits the passage of an aggressor through foyer 134 and vestibule 24, and hence inhibits passage through entrance 28 and ingress into sensitive structure 30.

If an assault effects a penetration 130 of door 32, even if penetration 130 does not breach door 32, then penetration 130 may fracture sealed tube 96. Foaming agent 98 is contained under pressure within sealed tube 96. When sealed tube 96 is fractured, foaming agent 98 is released and rapidly expands into adhesive foam 138, protruding into and filling penetration 130. Hence, the insertion of an explosive charge into or through penetration 130 to effect a second assault is impeded, as is passage through door 32, passage through passway 20, passage through entrance 28, and ingress into sensitive structure 30.

If an explosive assault effects a breach 130 of door 32 in a direction from an outside 140 of door 32, having outer cladding 90, to an inside 142 of door 32, having inner cladding 84, breach 130 fractures sealed tubes 96 and releases foaming agent 98 contained under pressure therein. Released foaming agent 98 rapidly issues forth and expands into adhesive foam 138. Adhesive foam 138 protrudes into breach 130, flows down outside 140 of door 32, and forms an adhesive mass 144 on floor 40 of vestibule at a bottom 146 of outside 140 of door 32. Adhesive mass 144 is effectively a wedge inhibiting door 32 from being opened. Hence, passage through passway 20 is impeded, as is passage through entrance 28 and ingress into sensitive structure 30.

Adhesive foam 138 both flows as a result of its expansion and is propelled by the explosive assault into various areas of vestibule 24 and coats portions of vestibule 24 and debris 133 contained therein. An aggressor attempting to effect passage of vestibule 24 comes into contact with and adheres to coated debris 133 and portions of vestibule 24. Hence, passage through passway 20 is impeded, as is passage through entrance 28 and ingress into sensitive structure 30.

Foaming agent 98 is configured to be substantially chemically inert. By being chemically inert, foaming agent 98 has an extended shelf life, not significantly altering in composition over time. Also, by being chemically inert foaming agent 98 does not attack and cause a significant deterioration of tubes 96 housing foaming agent 98. These properties allow door 32 to remain in service for an extended time without a loss of its penetration-reactive properties.

Additionally, because foaming agent 98 is substantially chemically inert, an antipersonnel chemical agent, e.g., a dermotropic toxin, may be added to foaming agent 98. With such an additive, an aggressor coming into contact with adhesive foam 138 will be incapacitated. Hence, the ability of that aggressor to effect passage through passway 20 is impeded, as is passage through entrance 28 and ingress into sensitive structure 30.

The structure of passway 20 is such as to inhibit ingress into sensitive structure 30 for a length of time sufficient to allow a guard to arrive from a central guard station. This is accomplished by passway 20 being of sufficient strength to effectively block all attempts at ingress not involving explosive penetrations, and, when explosive penetrations are employed, utilizing a plurality of passive and active measures to inhibit ingress for a time greater than that required for a guard to detect the assault and arrive.

In a worst-case exemplary scenario, an aggressor may attempt ingress by committing a series of explosive assaults upon passway 20. The aggressor makes a first assault upon outer door 32 for the purpose of breaching door 32. To effect this first assault, the aggressor places a charge upon outer door 32 and departs.

Ideally, the mere attempt of an aggressor to effect such an assault would violate perimeter and adjacent area security, triggering intrusion alarms, alerting the guard, and causing electric deadbolts 126 on both outer and inner security doors 32 and 46 to be extended before the aggressor can approach outer door 32. In this worst-case scenario, however, it shall be assumed that, through espionage, subversion, or other means, the aggressor has effectively circumvented external security measures and the assault upon outer door 32 is the first indication of intrusion. In this scenario, therefore, this first assault may be assumed to succeed, triggering intrusion alarms, starting the guard on its way, and causing both outer and inner doors 26 and 46 to be locked into place by electric deadbolts 126.

Additionally, this first assault may cause at least some passive antipersonnel devices 56 within walls 38 of outer vestibule 24 to be activated. This incapacitates an aggressor remaining in area 62 adjacent to outer vestibule 24. Additionally, some debris 133 is created through fragmentation of that portion of door 32 that is now breach 130 and through spalling of concrete 34 from walls 38.

The aggressor then makes a second assault in which a second, rather large charge is placed inside outer vestibule 24 to remove door 32 from doorframe 70. To effect this, the aggressor approaches outer door 32, passes the charge through breach 130, and departs. The aggressor is impeded in these actions by the necessity of navigating through adhesive foam 138 and debris 133 upon floor 40 of foyer 134, by the necessity of clearing breach 130 of adhesive foam 138, and by the necessity of exercising care in the passage of the charge through the jaggedness and sharp edges and points of breach 130. Additionally, this second assault causes those passive antipersonnel devices 56 not activated by the first assault to be activated, incapacitating an aggressor within adjacent area 62.

The aggressor then makes a third assault to breach inner door 46. To effect this assault, the aggressor has to navigate through the remains of outer door 32, essentially occupying foyer 134 and liberally intermingled with debris 133 and covered with adhesive foam 138, effect passage of outer vestibule 24, containing extensive debris 133, including spalled portions of vestibule 24 and fragments of door 32, as well as additional adhesive foam 138, plant the charge, and depart. Additional hindrance to the accomplishment of this third assault is provided by debris 133 and adhesive foam 138 produced by the second assault. Since the second assault effectively destroyed outer door 32, it also fractured all tubes 96 and released all foaming agent 98 not previously fractured and released by the first assault. This produces a large quantity of adhesive foam 138 commingled with a substantial quantity of debris 133, all of which needs be removed and/or otherwise navigated in order for the aggressor to access inner door 46 and effect the third assault.

This third assault causes at least some passive antipersonnel devices 56 within walls 38 of inner vestibule 44 to be activated. This incapacitates an aggressor remaining in area 62 adjacent to inner vestibule 44.

The aggressor then makes a fourth assault, similar to the second assault, to remove inner door 46. A fifth (and possibly sixth) assault, similar to the third (and fourth) assault, needs then be made upon entrance 28 before the aggressor can effect ingress to sensitive structure 30. Only after gaining ingress to structure 30 may the aggressor begin an assault upon the actual target. Each of these assaults requires the aggressor to approach, plant the appropriate explosive charge, and depart to allow the explosion to occur. Each of these assaults creates an increasingly greater obstacle to passage, hence increases the time required for the aggressor to approach and depart. With this increasing delay for each assault, the guard has sufficient time to arrive and take appropriate action to curtail the activities of the aggressor.

In summary, penetration-resistive modular security passway 20 is positioned adjacent to entrance 28 of sensitive structure 30. Once positioned, passway 20 utilizes a plurality of different devices and constructs to inhibit the passage of an aggressor through passway 20, and hence passage through entrance 28 and ingress into sensitive structure 30, while allowing free and safe ingress into and egress from sensitive structure 30 for authorized personnel and materiel. In the event of an assault upon passway 20, a plurality of passive and active means is employed by these devices and constructs to delay invasion sufficiently for an armed guard to arrive and prevent ingress.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A penetration-resistant modular security passway configured to secure a structure entrance, said passway comprising:

a concrete vestibule coupled to said structure entrance and controlling passage therethrough, said vestibule being fabricated of concrete into which a plurality of reinforcing members has been cast; and a penetration-reactive security door coupled to said concrete vestibule and controlling access thereto, said door comprising:

a substruction having a first face, a second face, an inside periphery, and a space within said inside periphery, a plurality of sealed tubes suspended within said space, and a foaming agent contained under pressure within said sealed tubes, and a metallic grate coupled to said first face;

wherein said door reacts to an explosive penetration thereof so as to inhibit transit of said passway.

2. A penetration-resistant modular security passway as claimed in claim 1 wherein:

said concrete vestibule has a wall; and said concrete vestibule comprises an antipersonnel device embedded within said wall.

3. A penetration-resistant modular security passway as claimed in claim 2 wherein:

said antipersonnel device is a passive antipersonnel device having projectiles; and said vestibule wall and said antipersonnel device are configured so that an explosive penetration of said passway causes said antipersonnel device to propel said projectiles into an external area proximate to said wall.

4. A penetration-resistant modular security passway as claimed in claim 1 wherein said concrete vestibule comprises a doorframe to which said penetration-reactive security door is coupled, said doorframe comprising:

a hinge jamb rigidly coupled to one of said reinforcing members;

a plurality of studs coupled to said hinge jamb, said studs protruding into said door when said door is in a closed position;

a strike jamb rigidly coupled to one of said reinforcing members;

a plurality of deadbolts coupled to said strike jamb, said deadbolts being extendible to protrude into said door when said door is in said closed position; and a doorstop formed within said doorframe and against which said door is set when said door is in said closed position.

5. A penetration-resistant modular security passway as claimed in claim 1 wherein said penetration-reactive security door is coupled to said concrete vestibule in a location and a position such that a shock wave from an explosive penetration of said door will not perpendicularly assault said structure entrance.

6. A penetration-resistant modular security passway as claimed in claim 5 wherein said penetration-reactive security door is coupled to said concrete vestibule at substantially a right angle to said structure entrance.

7. A penetration-resistant modular security passway as claimed in claim 1 wherein:

said concrete vestibule is an outer concrete vestibule;

said passway additionally comprises an inner concrete vestibule coupled to said structure entrance and said outer concrete vestibule and controlling passage between said structure entrance and said outer concrete vestibule;

said penetration-reactive security door is an outer penetration-reactive security door; and said passway additionally comprises an inner penetration-reactive security door coupled to one of said outer and inner concrete vestibules to control passage between said outer and inner concrete vestibules.

8. A penetration-resistant modular security passway as claimed in claim 7 wherein:

said outer security door is coupled to said outer concrete vestibule in a location and a position such that a shock wave from an explosive penetration of said outer security door will not perpendicularly assault said inner security door; and said inner security door is coupled at a location and a position such that a shock wave from an explosive penetration of said inner security door will not perpendicularly assault said structure entrance.

9. A penetration-resistant modular security passway as claimed in claim 8 wherein said outer security door is coupled to said outer concrete vestibule at substantially a right angle to said inner security door.

10. A penetration-resistant modular security passway as claimed in claim 1 wherein said penetration-reactive security door additionally comprises:

a first cladding coupled to said first face through said metallic grate;

a second cladding coupled to said second face; and a metallic cable woven throughout said space and coupled to said inside periphery at a plurality of locations.

11. A penetration-resistant modular security passway as claimed in claim 10 wherein said door additionally comprises a girdle having:

a first reinforcement plate centrally located along a vertical dimension of said door and coupled to an outside of said first cladding;

a second reinforcement plate centrally located along said vertical dimension and coupled to an outside of said second cladding; and an inter-plate attachment device coupling said first reinforcement plate to said second reinforcement plate through said door.

12. A penetration-resistant modular security passway as claimed in claim 1 wherein:

an assault upon said door creates a penetration thereof and fractures one of said sealed tubes to release said foaming agent; and said foaming agent expands into an adhesive foam that protrudes into said penetration.

13. A penetration-resistant modular security passway as claimed in claim 12 wherein:

said assault is an explosive assault causing said penetration to breach said door in a direction from a first side to a second side of said door;

said foam is released to flow from said penetration towards and down said first side; and said foam accumulates into an adhesive mass at a bottom of said first side to inhibit opening said door.

14. A penetration-resistant modular security passway as claimed in claim 1 wherein:

an explosive assault upon said door creates a breach therein;

said breach renders a portion of said metallic grate within said breach into debris and propels said debris into said concrete vestibule; and said metallic grate is fabricated of materials configured to produce sharp edges to said breach and throughout said debris.

15. A penetration-resistant modular security passway as claimed in claim 1 wherein:

an explosive assault upon said door causes a breach therein; and said breach renders a portion of said door into debris, a portion of which occupies said concrete vestibule and inhibits passage therethrough.

16. A penetration-resistant modular security passway as claimed in claim 1 wherein an explosive assault upon said passway spalls said concrete vestibule and renders a portion thereof into debris, a portion of which occupies said vestibule and inhibits passage therethrough.

17. A penetration-resistant modular security passway as claimed in claim 1 wherein:

said security door has a surface area;

said concrete vestibule comprises a floor having a surface area; and said surface area of said door is greater than ten per cent of said surface area of said floor.

18. A penetration-resistant modular security passway as claimed in claim 1 wherein:

said security door has a height;

said concrete vestibule comprises a foyer;

said concrete vestibule additionally comprises a strike wall facing said security door and separated from said security door by said foyer; and a dimension of said foyer between said security door and said strike wall is less than said height of said security door.

19. A penetration-resistant modular security passway as claimed in claim 1 wherein said concrete vestibule includes a means for engagement of a lifting mechanism to facilitate movement of said vestibule.

20. A penetration-resistant modular security passway as claimed in claim 19 wherein said engagement means comprises a plurality of lifting lugs attached to a plurality of said reinforcing members cast within a roof of said concrete vestibule.

21. A penetration-reactive security door for a passway, said door comprising:

a substruction having a first face, a second face, an inside periphery, and a space within said inside periphery, a metallic grate coupled to said first face, a first cladding coupled to said metallic grate, a second cladding coupled to said second face, and a metallic cable strung throughout said space and coupled to said inside periphery at a plurality of locations;

wherein said door reacts to an explosive penetration thereof so as to inhibit transit of said passway.

22. A penetration-reactive security passway door as claimed in claim 21 wherein said metallic grate is a first metallic grate and said door additionally comprises a second metallic grate coupled between said second face and said second cladding.

23. A penetration-reactive security passway door as claimed in claim 22 wherein said first metallic grate is coupled to said second metallic grate through said space by an inter-grate attachment device.

24. A penetration-reactive security passway door as claimed in claim 21 wherein one of said first and second claddings is fabricated of armor plate.

25. A penetration-reactive security passway door as claimed in claim 21 additionally comprising a girdle including:

a first reinforcement plate coupled to an outside of said first cladding;

a second reinforcement plate coupled to an outside of said second cladding; and an inter-plate attachment device coupling said first reinforcement plate to said second reinforcement plate through said door.

26. A penetration-reactive security passway door as claimed in claim 21 additionally comprising:

a plurality of sealed tubes suspended within said space; and a foaming agent contained under pressure within said sealed tubes.

27. A penetration-reactive security passway door as claimed in claim 26 wherein:

an assault upon said door sufficient to create a penetration thereof fractures one of said sealed tubes and releases said foaming agent contained therein; and said foaming agent expands into an adhesive foam and protrudes into said penetration upon the fracturing of said one of said tubes.

28. A penetration-reactive security passway door as claimed in claim 27 wherein:

said assault is an explosive assault;

said penetration breaches said door in a direction from a first side to a second side thereof;

said foam is released and flows from said penetration towards and down said first side; and said foam accumulates into an adhesive mass at a bottom of said first side to inhibit opening said door.

29. A penetration-reactive security passway door as claimed in claim 26 wherein each of said sealed tubes is individually sealed.

30. A penetration-reactive security passway door as claimed in claim 26 wherein:

an antipersonnel chemical agent is added to said foaming agent; and said foaming agent is configured to be substantially inert with respect to said added chemical agent.

31. A penetration-resistant modular security passway comprising:

a concrete vestibule coupled to a structure entrance and controlling passage therethrough, said vestibule having a plurality of reinforcing members cast therein and a plurality of lifting lugs located thereon;

a passive antipersonnel device embedded within a wall of said vestibule;

a penetration-reactive security door controlling access to said vestibule, said door having a substruction with a first face, a second face, an inside periphery, and a space within said inside periphery, said door also having a first grate affixed to said first face, a first cladding affixed to said first grate, a second grate affixed to said second face, and a second cladding affixed to said second grate;

a metallic cable woven throughout said space and coupled to said inside periphery at a plurality of locations;

a plurality of individually sealed tubes suspended within said space, said sealed tubes containing a foaming agent under pressure;

a girdle having a first reinforcement plate affixed upon said first cladding, a second reinforcement plate affixed upon said second cladding, and an inter-plate attachment device affixing said first reinforcement plate to said second reinforcement plate through said door; and a doorframe having a hinge jamb attached to one of said reinforcing members and a plurality of studs for protrusion into said door, and said doorframe having a strike jamb attached to one of said reinforcing members and a plurality of deadbolts for protrusion into said door.

32. A penetration-resistant modular security passway configured to secure a structure entrance, said passway comprising:

a concrete vestibule coupled to said structure entrance and controlling passage therethrough, said vestibule being fabricated of concrete into which a plurality of reinforcing members has been cast, and said vestibule including a means for engagement of a lifting mechanism to facilitate movement of said vestibule;

said concrete vestibule has a wall;

said concrete vestibule comprises an antipersonnel device embedded within said wall; and a penetration-reactive security door coupled to said concrete vestibule and controlling access thereto.

33. A penetration-resistant modular security passway as claimed in claim 32 wherein:

said antipersonnel device is a passive antipersonnel device having projectiles; and said vestibule wall and said antipersonnel device are configured so that an explosive penetration of said passway causes said antipersonnel device to propel said projectiles into an external area proximate to said wall.

34. A penetration-resistant modular security passway configured to secure a structure entrance, said passway comprising:

a plurality of walls coupled together and configured to form a concrete vestibule, said walls being fabricated of concrete into which a plurality of reinforcing members has been cast;

a penetration-reactive security door coupled to one of said walls and configured to control access to said vestibule; and an antipersonnel device embedded within one of said walls.

35. A penetration-resistant modular security passway as claimed in claim 34 wherein:

said antipersonnel device is a passive antipersonnel device having projectiles; and said one wall and said antipersonnel device are configured so that an explosive penetration of said security door causes said antipersonnel device to propel said projectiles into an external area proximate to said one wall.

* * * * *